United States Patent [19]

Russell et al.

[11] Patent Number: 4,528,831

[45] **Date of Patent: * Jul. 16, 1985**

[54] WIRE COILING MACHINE

[75] Inventors: Frank S. Russell, Northboro; Robert J. Simonelli, Grafton, both of Mass.

[73] Assignee: Sleeper & Hartley Corp., Worcester, Mass.

[ * ] Notice: The portion of the term of this patent subsequent to Sep. 6, 2000 has been disclaimed.

[21] Appl. No.: 497,756

[22] Filed: May 25, 1983

Related U.S. Application Data

[63] Continuation of Ser. No. 251,194, Apr. 6, 1981, Pat. No. 4,402,204, which is a continuation-in-part of Ser. No. 201,204, Oct. 27, 1980, Pat. No. 4,372,141.

[51] Int. Cl.[3] ..... B21F 3/02; B21F 11/00

[52] U.S. Cl. ..... 72/131; 72/135

[58] Field of Search ..... 72/129, 131, 132, 135, 72/138

[56] References Cited

U.S. PATENT DOCUMENTS

| | | | |
|---|---|---|---|
| 3,009,505 | 11/1961 | Franks, Jr. | 72/132 |
| 3,740,984 | 6/1973 | Bergevin | 72/132 |
| 4,173,135 | 11/1979 | Lamperti | 72/138 |

*Primary Examiner*—E. Michael Combs

*Attorney, Agent, or Firm*—Wolf, Greenfield & Sacks

[57] ABSTRACT

A machine for coiling wire to form any one of a number of different size, type and configuration of coil spring and comprising a machine frame in which is mounted a driveshaft, intermediate shaft, camshaft, and feed roller shafts. At a work station of the machine appropriate coiling dies are supported along with one or more cutters mounted adjacent thereto. The wire is fed to the work station via a pair of feed rollers driven at variable speed, preferably by an elliptical gear drive, wherein the feed speed is at a maximum during coiling and decreases to a minimum feed speed for cutting. Wire feed is synchronously interrupted at cutting by means of a cam arrangement that briefly disengaged the feed rollers. This variable speed drive enables a high duty cycle of operation and also enables start up (feed rollers engaging) at reduced speed so as to minimize wire distortion. In an alternate form of wire feed, instead of interrupting drive to the feed rollers by a cam arrangement, a clutch is used to briefly stop motion for cutting. A further feature of the machine is the capability of removal of cams from the camshaft with all cams remaining in tact. In this way a set of cams can be later substituted to produce a particular spring construction without requiring constant cam adjustment.

22 Claims, 14 Drawing Figures

3
3
4
4
7
7
10
12
12A
14
14
16
18
20
22
24
25
26
26A
32
34
38
39
40
41
42
44
44A
44B
50
52
53
54
56
58
62
70
72
96
98
102
G1
G2
G3
G4
G5
G6
G7
G8
G9

72
70
68
24
10
20
76
40
G8
96
38
G6
98
G5
G7
20
26A
G4
26
G3
12
12A
34
48
G1
14
G2
32

WIRE COILING MACHINE

RELATED APPLICATIONS

This application is a continuation of application Ser. No. 251,194, filed Apr. 6, 1981, now U.S. Pat. No. 4,402,204, which in turn is a continuation-in-part of application Ser. No. 201,204 filed Oct. 27, 1980, now U.S. Pat. No. 4,372,141.

BACKGROUND OF THE INVENTION

The present invention relates in general to wire coiling machines, and pertains more particularly, to a machine for coiling wire with an improved wire feed, preferably sinusoidally varying in feed speed, with intermittent feed interruption for cutting.

Various types of wire coiling machines are generally known in the art. By way of example, U.S. Pat. No. 1,266,070 to Sleeper and U.S. Pat. No. 2,175,426 to Blount et al show wire feed rollers that are in constant engagement with the wire but driven intermittently by means of a reciprocable gear segment of a variable throw. One of the problems with that construction was an appreciable loss of time in the necessity for returning the gear segment to its starting position at the same speed at its forward motion. By way of another example such as shown in U.S. Pat. No. 1,452,128 to Sleeper and U.S. Pat. No. 2,096,605 to Blount the wire feed rollers are driven through a clutch which is controlled by a cam mechanism arranged to stop the feed periodically for the wire cutting operation.

Generally speaking, there are two basic techniques that are presently employed for interrupting wire feed to accomplish the cutting of the wire after the spring has been formed. One technique controls the feed rollers so that they are stopped and motionless at the time of cutting. There is typically about a 120 degree dwell time thus providing only a $\frac{2}{3}$ duty cycle. This is time consuming and limits the numbers of springs that can be formed per minute.

Another present machine causes a lifting of one of the feed rollers to thus stop wire motion. However, this machine is provided with a constant speed drive of the feed rollers. In order to provide a suitable speed of production of springs, the feed rollers are driven at a constant speed that has now been found to create certain problems. Particularly, when the feed rollers are re-engaged there is a tendency for the wire to become distorted. Because of this re-engagement at full constant speed there is generally required a large pressure on the rollers to compensate for this high speed start. As previously mentioned, this creates wire distortion especially when coiling larger gage wires particularly in small coils. The wire distortion includes distortion of both pitch and diameter accuracy.

Accordingly, it is an object of the present invention to overcome the aforementioned disadvantages associated with prior art machines by providing a variable speed drive which enables a high duty cycle of operation and which also enables start-up at reduced speed so as to minimize wire distortion.

Another object of the present invention is to provide an improved wire coiling machine particularly characterized by an improved wire feed apparatus combining variable speed feed with intermittent feed interruption for cutting. The variable speed feed, preferably of sinusoidal type, varies between a maximum speed essentially at the midpoint of the coiling operation to a minimum speed at feed interruption. In the disclosed embodiment a pair of elliptical gears are used for the variable speed drive, although other means may be provided such as the use of other noncircular type gears.

Another object of the present invention is to provide a wire coiling machine characterized by improved accuracy in production in cutting of the coil spring.

The camshaft in a wire coiling machine is typically supported in bearings and adapted to be maintained fixed within the machine. This camshaft supports one or more cams, and usually on the order of 3–5 cams for control of such parameters as pitch, diameter and feed. When changing from making one spring configuration to another the usual technique is to readjust each of the cams which can be quite time consuming.

Thus, it is an object of the present invention to provide a wire coiling machine in which the cams may be readily removed from the camshaft with the cams maintained in tact in some predetermined setting for a particular spring. In this way when the same configuration of spring is to again be formed then the same cams are replaced on the camshaft, there thus being no requirement for continuous readjustment of individual cams when changing from one spring configuration to another.

SUMMARY OF THE INVENTION

To accomplish the foregoing and other objects of this invention, there is provided a wire coiling machine having a work station at which a coil spring or the like is formed and after forming cut by a suitably supported cutter. The wire coiling machine comprises a support frame which supports a number of shafts including a driveshaft, camshaft and intermediate shaft. The intermediate shaft drives a pair of feed rollers between which the wire is fed. The primary improvement in accordance with the present invention comprises means for driving at least one of the feed rollers at a variable drive speed to, in turn, feed the wire at a variable speed to the work station. In accordance with the invention there is also provided means for controlling wire feed to intermittently interrupt wire feed in synchronism with the cutting of the wire subsequent to the coiling thereof. The means for driving the feed rollers comprises means for controlling the speed of wire feed to have a maximum speed feed while coiling and decreasing to a minimum speed feed in synchronism with the intermittent interruption of wire feed.

In accordance with the mode of operation of the present invention, in the preferred version the feed rollers are operated at a variable speed which in the disclosed embodiment is at a sinusoidal rate having a maximum peak speed essentially at the midpoint of the coiling operation and decreasing in speed to a minimum speed concurrent with an intermittent interruption in wire feed. In accordance with the preferred embodiment of the invention, the intermittent interruption of feed is accomplished by means of separating the feed rollers to intermittently stop the wire feed. The means for separating these feedrollers preferably includes a lifting mechanism for lifting one of the rollers relative to the other feed roller which is preferably maintained stationery. This may include cam means responsive to the camshaft for operating the lifting of one of the feed rollers. This one feed roller is preferably biased toward the other feed roller under some predetermined adjustable tension.

The means that is employed for providing the variable speed drive preferably includes non-circular gear means. This gear means may comprise a pair of non-circular gears associated respectively, with the camshaft and intermediate shaft for driving the intermediate shaft at a variable speed when the camshaft is driven at a constant speed. The non-circular gears in the disclosed embodiment are elliptical gears.

As discussed previously, the preferred embodiment for interrupting feed is the separation of the feed rollers. In an alternate embodiment there may be provided a clutch means for intermittently interrupting feedroller rotation. The clutch means is operated to cease wire feed in synchronism with the minimum feed roller speed. Thus, in accordance with the method of this invention as the feed rollers rotate, they increase in speed to a maximum during the coiling operation and then the speed of the rollers decreases. At about the minimum roller speed a cam is operated from the camshaft to provide for intermittent interruption of wire feed substantially concurrently with operation of the cutter or cutters. Thereafter, the feed rollers are again driven but commencing again at substantially the minimum speed back up to a maximum speed of feed roller rotation during the following coiling sequence. This intermittent interruption may be facilitated as discussed previously either by separation of the feedrollers or by interruption of feed roller drive.

In accordance with another feature of the present invention the cams on the camshaft are readily replaceable with preferably all cams on the camshaft maintained in their set position. In order to provide this feature, which eliminates continuous adjustment of cams, there is preferably provided a flange supporting a bearing at one end of the camshaft which is readily removable to provide a sufficient diameter opening in a side of the housing so that the cams can be removed from the camshaft with all cams kept in this predetermined setting. This same set of cams may then be reinserted onto the camshaft when the same spring configuration is again to be formed.

BRIEF DESCRIPTION OF THE DRAWINGS

Numerous other objects, advantages and features of the invention will now become apparent upon a reading of the following detailed description taken in conjunction with the accompanying drawings, in which.

DETAILED DESCRIPTION

With reference to the drawings, there is disclosed a preferred embodiment of the wire coiling machine of the present invention. There are a number of parts of this machine that do not differ substantially from the parts or prior art machines, including the coiling and cutting apparatus. Discussed in more detail is the portion of the machine relating to the variable feed roller speed in combination with feed interruption.

FIGS. 1-9 show basically the details of the preferred embodiment.

Figure 10:
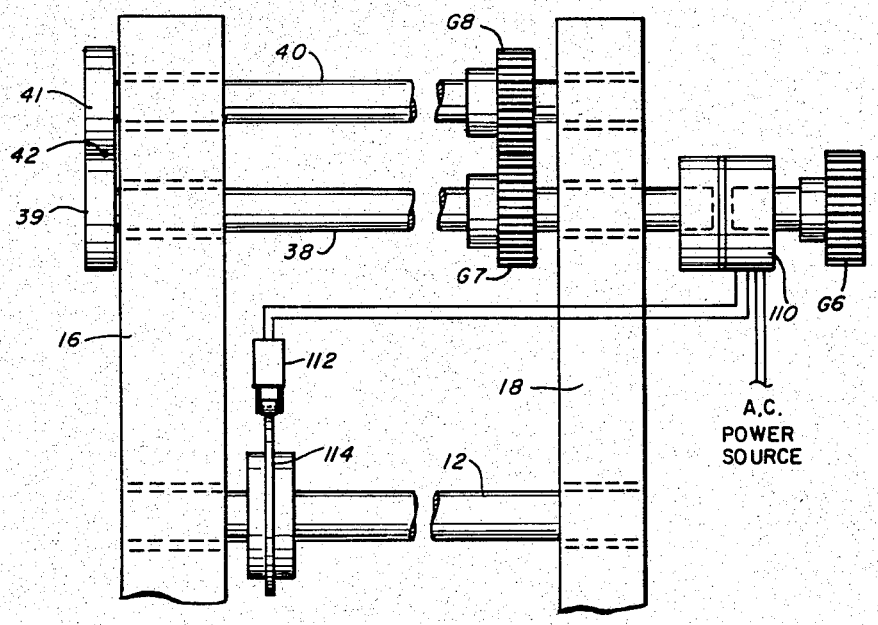
FIG. 10 schematically illustrates a modified portion of the machine for providing intermittent drive interruption.

FIG. 10 shows an alternate control for feed interruption.

Figure 2:
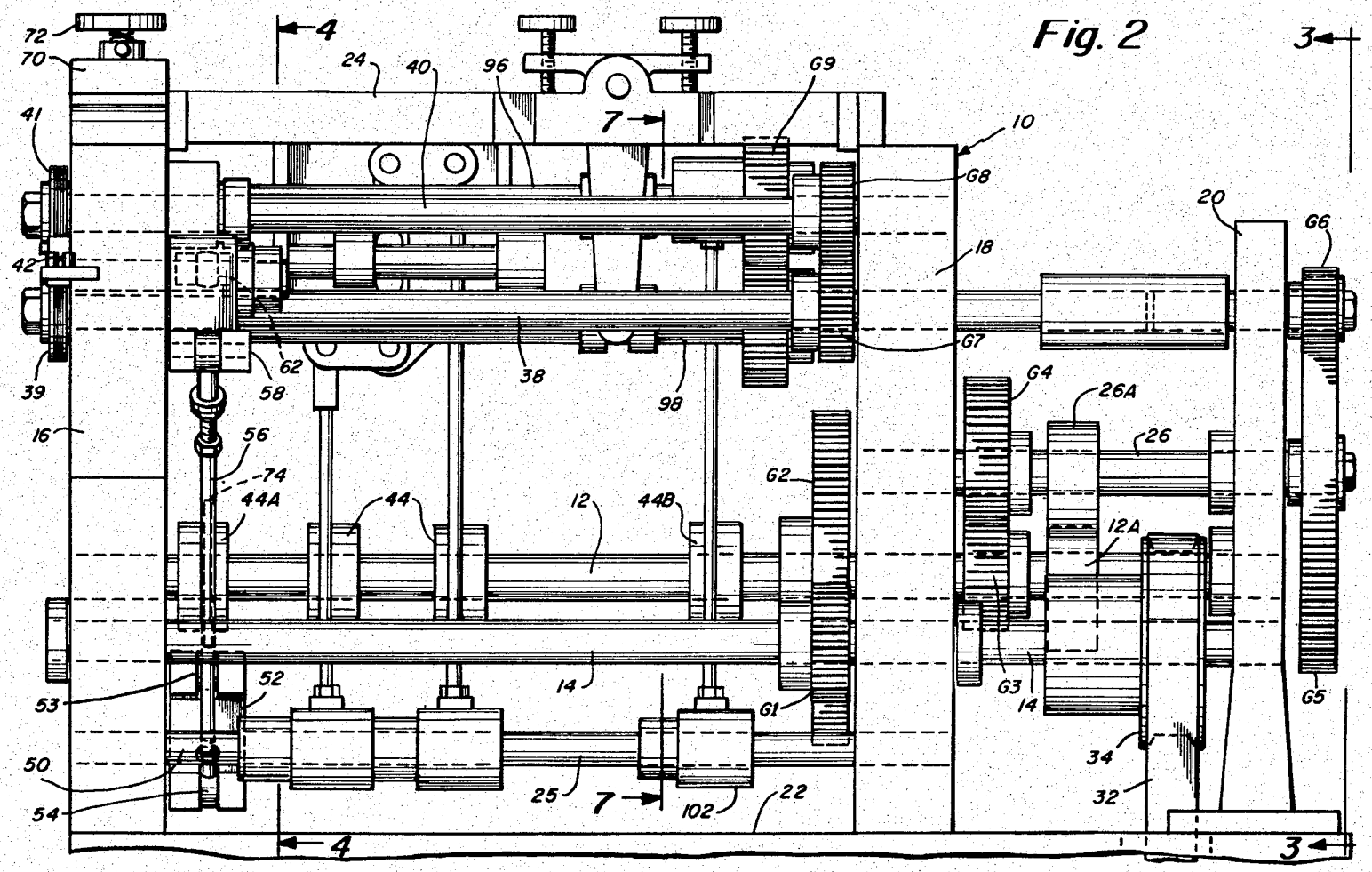
FIG. 2 is a front elevation view of the machine of FIG. 1 taken along line 2—2 of FIG. 1.
Figure 3:
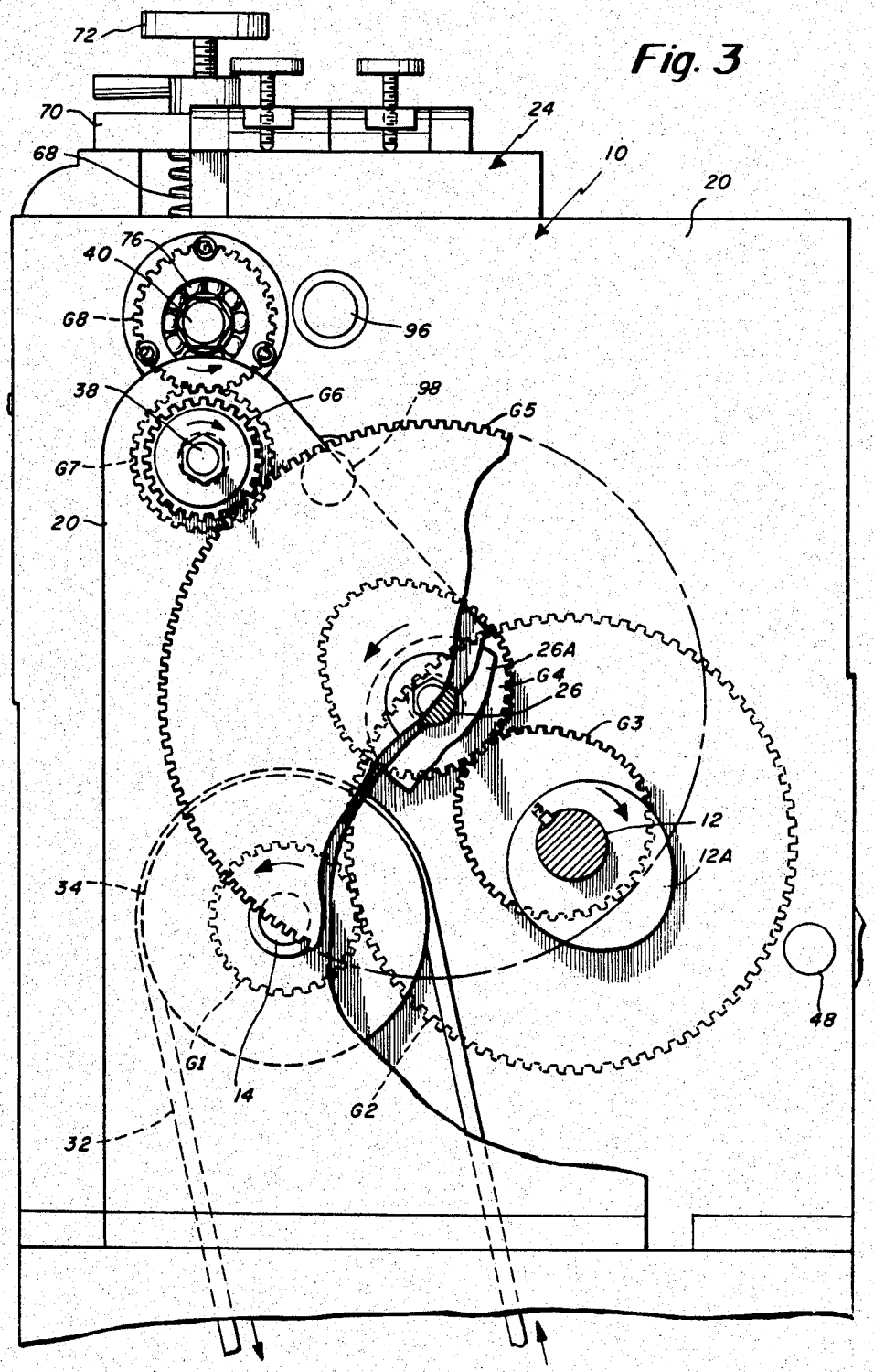
FIG. 3 is a side elevation view at the drive end of the machine as viewed along line 3—3 of FIG. 2 with portions of the machine cut away.

The wire coiling machine has a frame generally identified by the reference character 10 that provides the basic support for many of the components such as the camshaft 12 and driveshaft 14 both of which are illustrated, for example, in FIG. 2. Included as frame members are upright support members 16, 18 and 20, along with base 22 and top support member 24. There are many different configurations that can be employed for the support frame, the primary purpose simply being in supporting the main components of the machine such as the shafts and associated camming structures.

In addition to the camshaft 12 and the driveshaft 14 both of which are, of course, rotatable, there is also a stationery shaft 25 for supporting a number of cam arm pivots described hereinafter. There is also provided an intermediate shaft 26.

Figure 8:
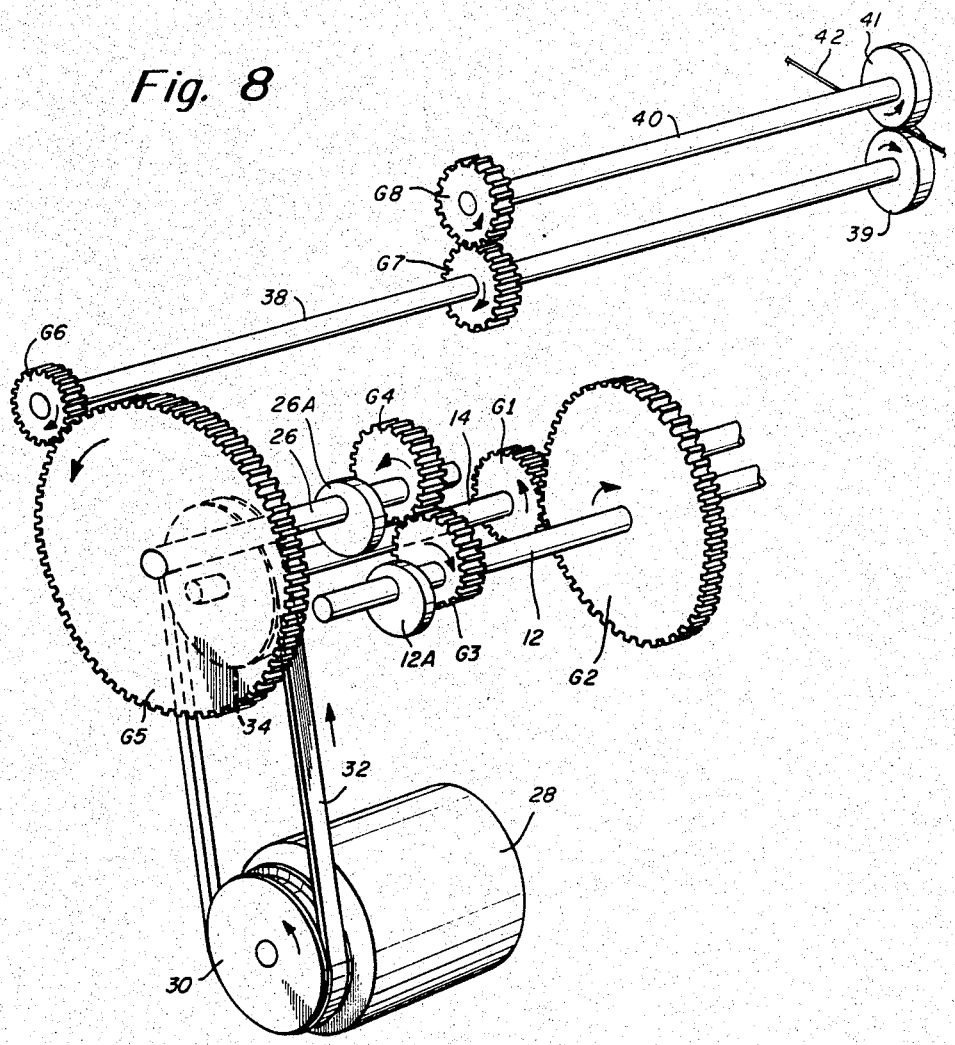
FIG. 8 is a perspective view showing primarily only the gearing arrangement of the present invention.

The gearing that is employed in this disclosed embodiment is now considered. In this regard reference is made in particular to FIGS. 1-3 and 8. In particular, FIG. 8 is a helpful illustration showing primarily only the gearing. It is to be understood that each of the shafts that support the gears are properly supported in the frame members such as upright members 16, 18 and 20. The support in these members is preferably by means of conventional bearings. For example, the drive shaft 14 is preferably supported by a bearing in the upright member 18 and extends in either side to the other upright members 16 and 20 in which it is also preferably supported in suitable bearings. Because of the number of bearings that are provided herein all of them may not be specifically identified but it is understood that these shafts are, of course, properly supported for respective rotation.

Now, with regard to the drawings and particularly the gearing arrangement illustrated in FIG. 8, there is provided a conventional drive motor 28 having an output drive pulley 30 which couples by way of a drive belt 32 to a driven pulley 34 suitably mounted on the drive shaft 14. This mounting may be in a conventional manner well-known for keying a pulley on to a shaft. The motor 28 may have controls associated therewith not shown in the drawings for controlling the speed of rotation of the drive shaft 14. A relatively small pinion gear G1 is fixedly secured to the drive shaft 14. FIG. 2 shows the placement of the gear G1 on the drive shaft 14 just inside of the upright support member 18. The drive gear G1 engages with a larger diameter gear G2 fixedly supported on the camshaft 12. The gear G2 as illustrated in FIG. 2 is, of course, also supported just inside of this upright support member 18. The camshaft 12 is driven at a speed related to the drive shaft speed by the ratio of the diameters of the gears G1 and G2. In the example illustrated the camshaft is driven at a slower speed than the drive shaft. It is noted that arrows are used in particular in FIG. 8 for illustrating the direction of rotation of each of the gears. Also keyed to the camshaft 12 is a first elliptical gear G3 which mates with a like elliptical gear G4 fixedly supported on to the intermediate shaft 26. Again, these gears are arranged to be in planar engagement. As illustrated in FIG. 2 the gears are supported just on the outside of the upright support member 18. FIG. 8 illustrates the two elliptical gears G3 and G4 in a position wherein the gears are engaged with gear G3 at its maximum diameter and gear G4 at its minimum diameter position. Because of the use of elliptical gears there is provided a counterweight 12A fixed to the camshaft 12 adjacent to gear G3 and a like counterweight 26A affixed to the intermediate shaft 26 adjacent to the second elliptical gear G4.

The intermediate shaft 26 as illustrated also in FIG. 2, couples between the upright members 18 and 20 and it is of course suitably supported in bearings in each one of these members. As indicated previously, the second elliptical gear G4 is affixed at essentially one end of the shaft 26. At the other end of the shaft 26, there is provided a relatively large gear G5 which as shown in FIG. 2 is disposed on the outside of the upright member 20. Gear G5 mates with a smaller gear G6 on a first feed shaft 38. The gears G5 and G6 are preferably provided in a matched set with the relative diameters of these gears being selected for the proper drive speed between the cam shaft 12 and the feed shaft 38. A reference is made hereinafter to FIG. 9 and an illustrated example of rotational speeds that are employed.

The feed shaft 38 has associated therewith a counterpart feed shaft 40. A gear G7 is fixed on to the shaft 38 and mates with a like gear G8 fixedly mounted onto the second feed shaft 40. Feed shafts 38 and 40 at their operative ends support, respectively, the feed rollers 39 and 41. Again, the gears G7 and G8 along with the rollers 39 and 41 may be keyed on to the feed shafts in any well-known suitable manner. It is noted that FIG. 8 also illustrates a wire 42 being fed intermediate the feed rollers 39 and 41. In the position shown in FIG. 8 these feed rollers are in engagement for driving the wire 42. Hereinafter reference will be made to FIG. 5 and a change in position of the feed shaft 40 to facilitate intermittent wire feed interruption.

Figure 9:
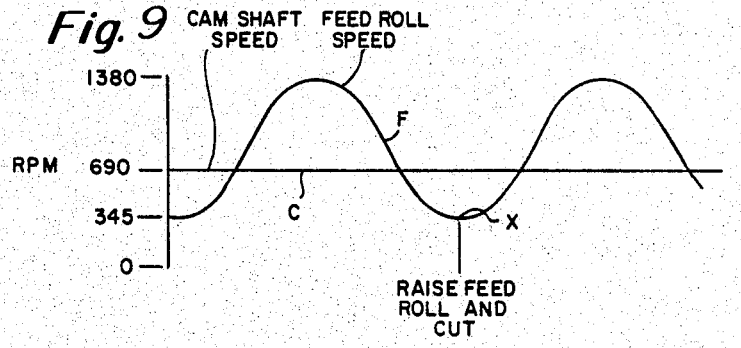
FIG. 9 is a speed graph showing feed roller speed and camshaft speed as it relates to the variable speed drive of this invention.

FIG. 9 is a speed graph showing basically two wave forms including waveform C which represents the cam shaft speed. In this example the cam shaft speed is 690 RPM. The other wave form F represents feed roll speed and it is noted that this is a sinusoidal waveform created by the use of the pair of elliptical gears G3 and G4. This wave form has a peak at about 1380 RPM and a minimum speed at about 345 RPM. In this example there is thus a ratio of 4 to 1 between the maximum and minimum feed roll speeds. At a cam shaft speed of 690 RPM this corresponds with a production rate of 690 springs per minute. Thus, the production rate of the machine is a function of the RPM of the camshaft, even though at the time of cutting as illustrated by the 345 RPM speed, there is a slowdown in feed. This is essentially compensated for by the rapid increase in feed to the maximum of 1380 between cuts.

With this variable speed feed of the invention there is also an added advantage of improved accuracy. The faster that the lift can occur at the feed rolls, the more accurate is the cutting operation. As indicated this lift occurs from the cam shaft. There is an increased accuracy when this lift occurs at a faster rate than the feed roll rotation. It can be seen from FIG. 9 that because of this variable speed operation, the accuracy is improved by virtue of this decreased feed speed so that at the normal cam operation of 690 RPM the feed speed is only 345 RPM. In previous machines wherein the cam speed and feed speed were synonymous, then for the same feed speed with the prior arrangement the accuracy was one-half or, in other words for the same accuracy as with the previous machines one can feed twice the amount of wire with the machine of this invention at the same degree of accuracy.

FIG. 9 is only one illustration of a specific relationship between the cam shaft speed and feed roller speed. In fact, the embodiment of FIG. 8 may or may not correspond to the wave forms shown in FIG. 9. However, regardless of the relationship between these two speeds, it is assumed that the cam shaft speed is constant and that the feed roller speed is variable preferably in a sinusoidal manner as depicted in FIG. 9. By selection of different ratio gears G5, G6 the wave forms C and F in FIG. 9 are essentially shifted up and down relative to each other to provide different ratios depending upon the particular application. However, in each of these applications, again, the cam shaft speed is considered as a constant speed and the feed roller speed varies between maximum and minimum values. FIG. 9 also illustrates at the point X the general area wherein the feed is intermittently interrupted. The two embodiments for facilitating this are described in detail hereinafter.

Figure 1:
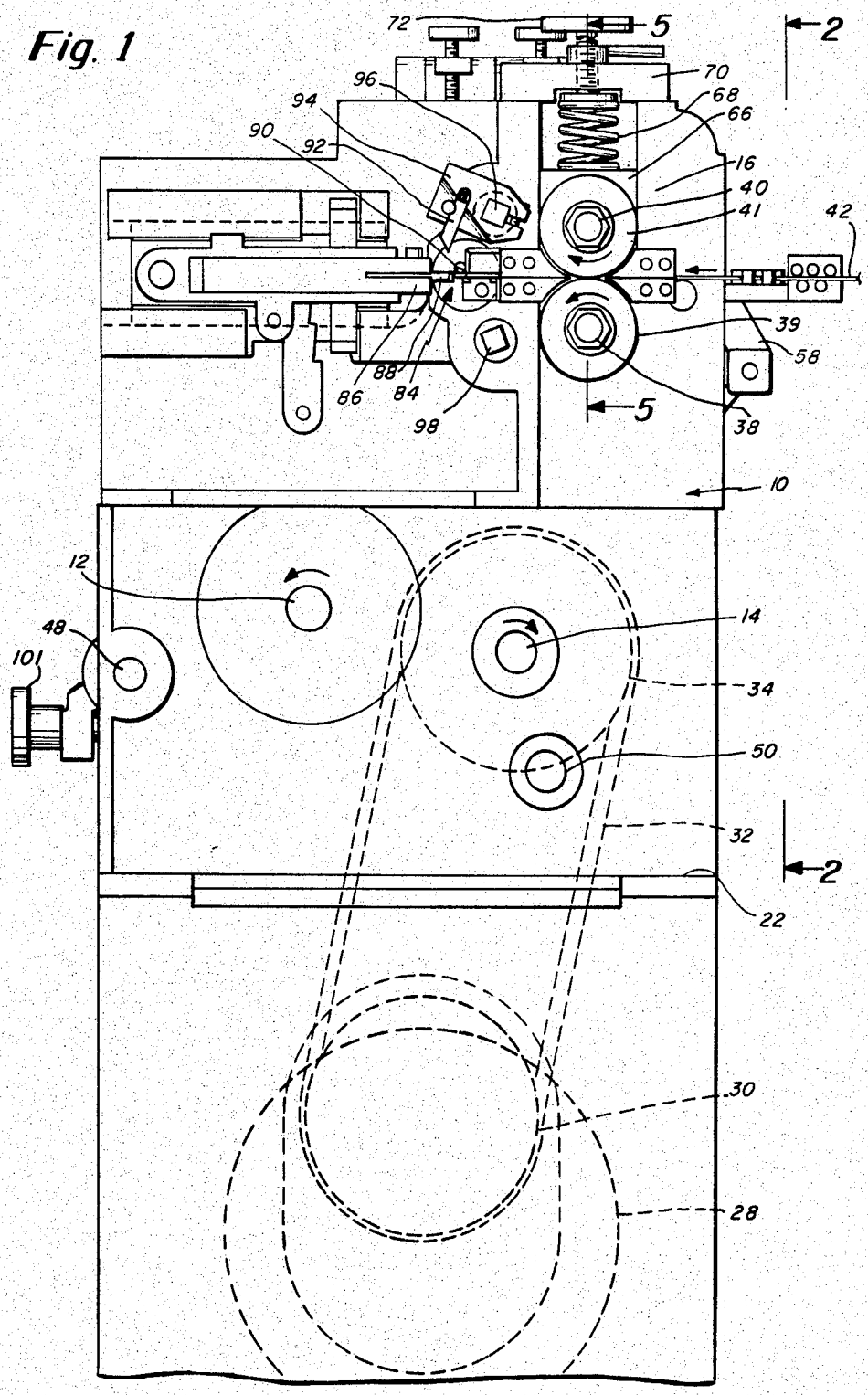
FIG. 1 is a side elevation view of a preferred embodiment of the wire coiling machine of this invention.
Figure 4:
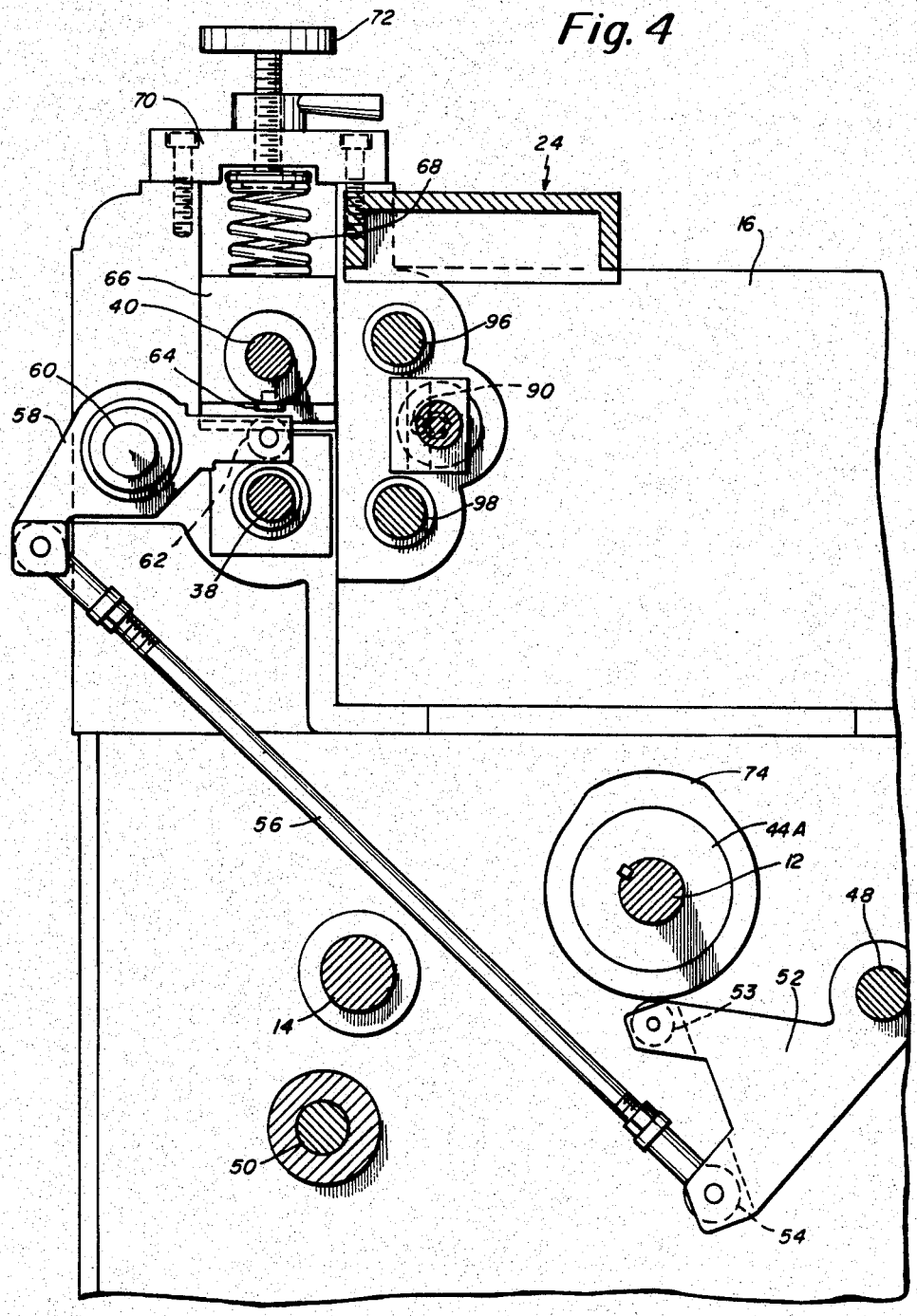
FIG. 4 is a cross-sectional view showing cam operation and as taken along line 4—4 of FIG. 2.
Figure 5:
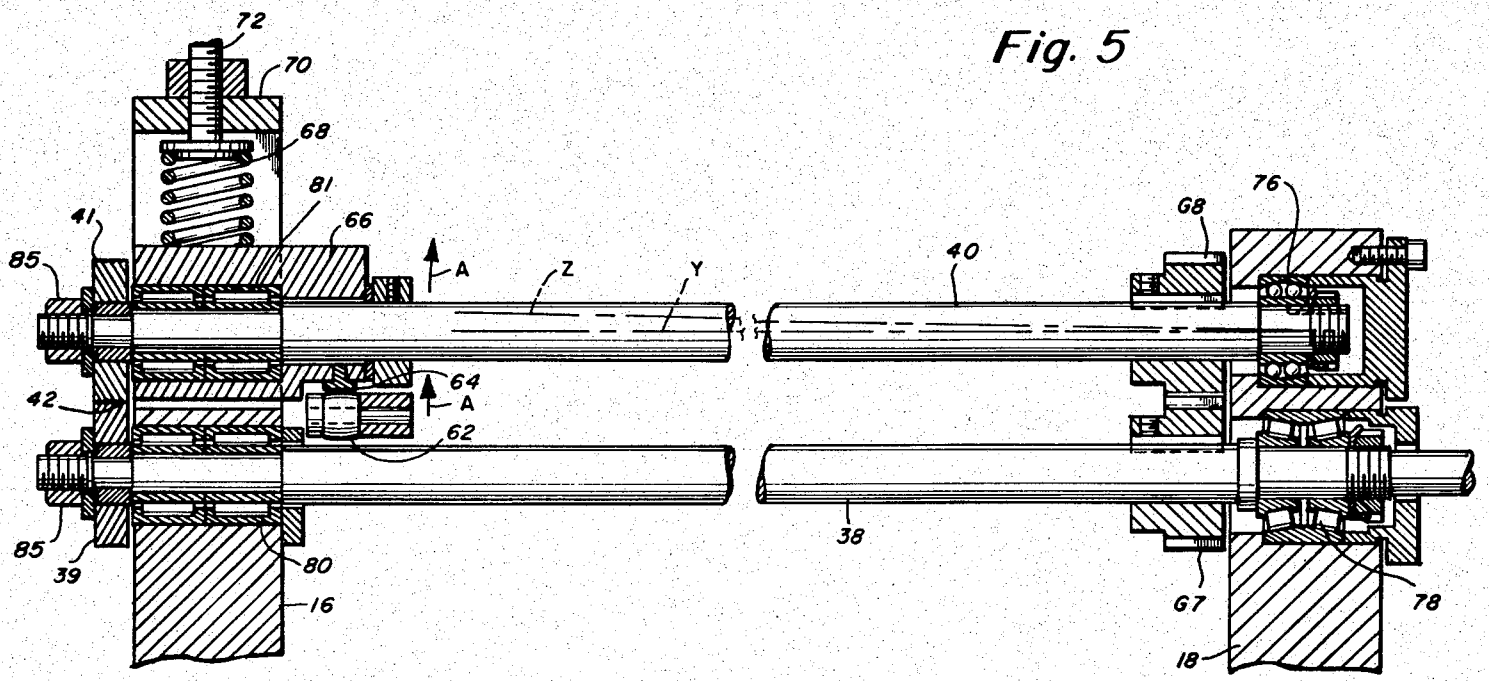
FIG. 5 shows details of the feed rollers and associated feedshafts as taken along line 5—5 of FIG. 1.

The cam shaft 12 carries a number of differently arranged cams 44 for providing different functions associated with the machine such as controlling, cutting and feed interruption, as well as parameters effecting the form of the spring. One of the cross sectional views taken through the machine is shown in FIG. 4 and this illustrates one of the cams 44A mounted on the cam shaft 12. This cam operates a mechanism for providing the lifting of the feed roller 41. In this connection, reference is also made to FIG. 5 which is a cross-sectional view taken along line 5—5 of FIG. 1, taken through the feed rollers. As illustrated in FIG. 4, there is a cam arm pivot 48 and also a cam arm pivot 50 also illustrated in FIG. 2. The cam arm pivot 48 supports a cam follower 52 having one leg 53 operated from the cam 44A. The other leg 54 of the cam follower couples to a lift arm 56. The lift arm 56 also couples to a pivot member 58 supported on a fixed support shaft 60. The pivot member 58 has an arm 62 adapted to engage a post 64 associated with the support block 66. The block 66 carries the upper feed shaft 40 suitably supported therein. FIG. 5 clearly illustrates the feed rollers 39 and 41 associated respectively with the shafts 38 and 40. FIG. 5 also illustrates the wire 42 that is being engaged between the feed rollers 39 and 41. The arm 62 is shown engaging the post 64 on the support block 66. FIGS. 1, 4 and 5 illustrate the block 66 and the associated biasing spring 68. Above the spring 68 is disposed a cap 70 for receiving adjusting screw 72 which is adapted to engage with the spring 68 in an adjustable manner to control the amount of force imposed downwardly on the support block 66. This biasing force is also transmitted by way of the lifting rod 56 to seat the leg 53 against the cam 44A. As the cam 44A rotates, the shoulder 74 of the cam will engage with the cam follower and cause through the lifting arm 56 counterclockwise rotation of the pivot member 58 whereby this member engages with the support block 66 and causes a lifting of the support block and also a lifting, of course, of the top feed roll 41. This cam action is in accordance with the present invention synchronized with the minimum speed of the feed rollers. Thus, the particular positions of the eccentric gears G3 and G4 is controlled to correspond with the appropriate setting of the high point 74 of the cam 44A. In this connection, in the illustration of FIG. 8 the eccentric gears happen to be shown in a position of maximum feed roller speed. Accordingly, in that position of the eccentric gears the cam shaft and its associated cam 44A is about in the position of FIG. 4 directly opposite to the point of lifting. When the cam shaft progresses through one-half rotation, then the lifting occurs and at the same time the eccentric gears are in their opposite position of minimum feed roll speed, or in the example given, 345 RPM.

FIG. 5 also illustrates the biasing spring 68 for the block 66. It is noted that the block 66 is free to move up in the direction of the arrows A indicated in FIG. 5. The other feed roll shaft 38, however, is maintained stationery. Both of the shafts 38 and 40 are suitably supported by bearing means at either end. In the upright support member 18, there is shown a bearing 76 that is particularly constructed to permit drive of the feed shaft 40 even while the lifting occurs. Similarly, there is provided a bearing 78 in the upright support member 18 for supporting the feed shaft 38. In this particular arrangement, the feed shaft 38 is considered as coupling through the bearing 78 on to the other section of this shaft driven from the gear G6 as schematically illustrated in FIG. 8.

FIG. 5 also illustrates by phantom center lines the approximate positions of the lifted feed shaft 40. A first line Y illustrates the position of the shaft 40 during the feeding operation and as shown in FIG. 5. There is also a second phantom line Z which illustrates the manner in which the feed shaft 40 is tilted from the bearing end 76 when the block 66 is lifted. As indicated previously, this lifting occurs at the cam shaft speed whereas at the same time the feed roll shaft rotation is at one-half of cam shaft speed providing improved accuracy for feeding and cutting at that particular speed of production.

Within the upright support block 16, there are also provided rotational support members 80 and 81 associated respectively with the feed shafts 38 and 40. There are also provided at the end of these feed shafts securing nuts 85 as shown in FIG. 5.

The other basic operation that is defined herein is the cutting operation. In this regard reference may be made to FIGS. 2, 6 and 7. The cutting sequence is also initiated off of the cam shaft 12. The cutting operation is described herein for the purpose of completeness, however, the particular invention described and claimed herein is not to be related particularly to the cutting operation but rather to the feed concepts described herein.

Figure 6:
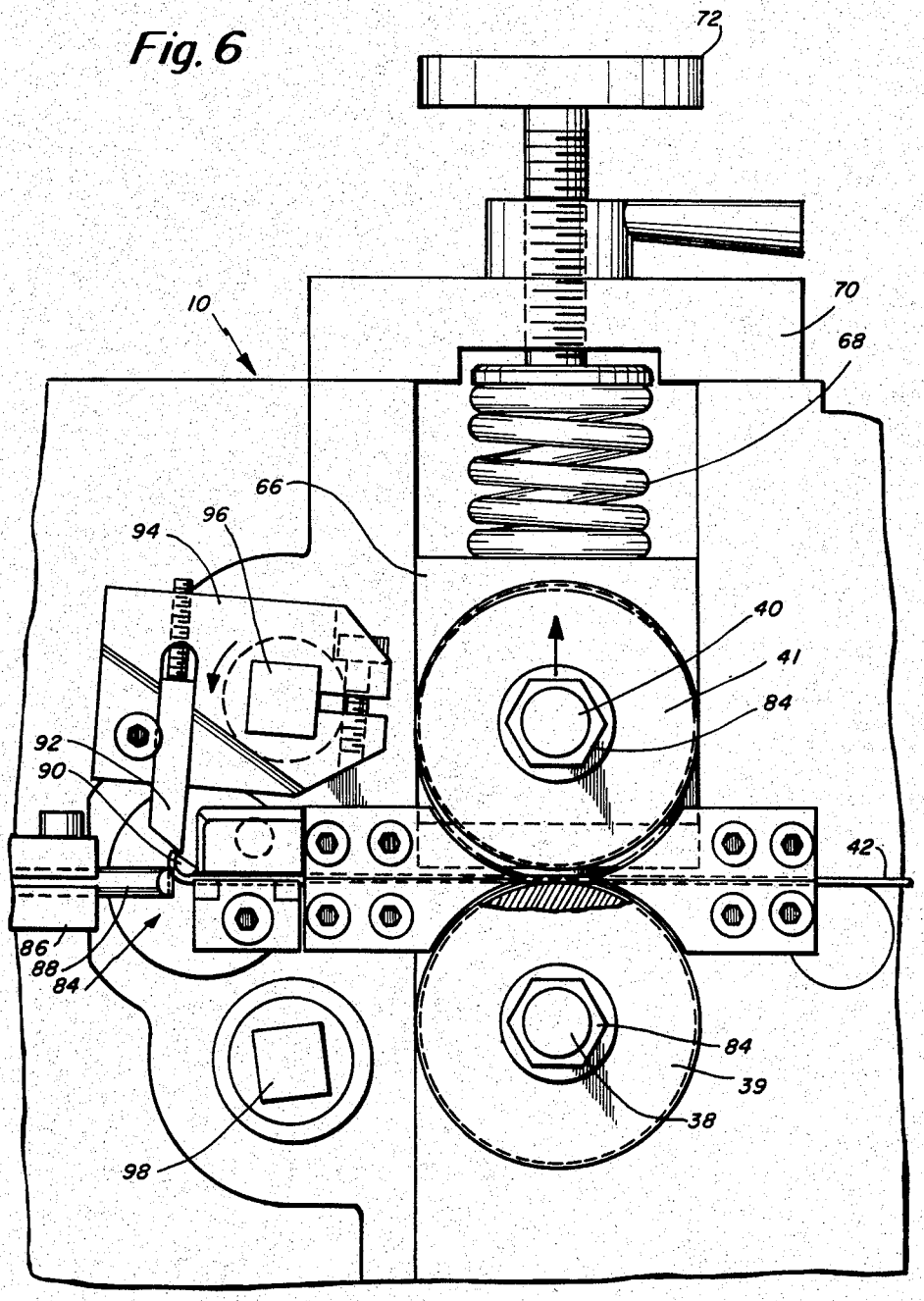
FIG. 6 is a fragmentary view taken from FIG. 1 showing in greater detail and enlarged in the vicinity of the work station and associated feedrollers feeding the wire to be formed into a coil.

Also with reference to FIG. 1, the machine may be considered as having a work station 84 at which the coiling and cutting operations occur. In this regard FIG. 6 shows an enlarged view of the work station 84. At this station a chuck 86 supports a moveable groove coiling point 88 which forces the wire to form into a coil around an arbor 90 supported by a tool holder. The wire 42 is fed from the feed rollers 39 and 41 forward between guide members that restrict the path of the wire as it approaches the grooved coiling point 88 and arbor 90. The diameter of the coil is controlled by moving the coiling point 88 toward or away from the arbor. The control of the point 88 may be from the cam shaft, although herein no specific details are shown of that type of control as it is not considered as being a part of the present invention. The pitch or spacing of the coils may be determined by a pitch tool, not specifically illustrated, which engages the wire behind the first coil and causes the adjacent coils to be spaced in accordance with the laterally adjustable position of that tool. After a suitable length of wire has been coiled, a cutter is brought into engagement with the wire and severs it against the cutting edge of the arbor 90. The machine that is illustrated herein is set up for two cutters, but in the disclosed embodiment, only a single cutter 92 is illustrated. This cutter 92 is shown held in a chuck 94 suitably secured to one of the cut-off shafts, namely shaft 96. FIG. 6 also shows the other shaft 98 therebelow but not used in the particular described embodiment.

Figure 7:
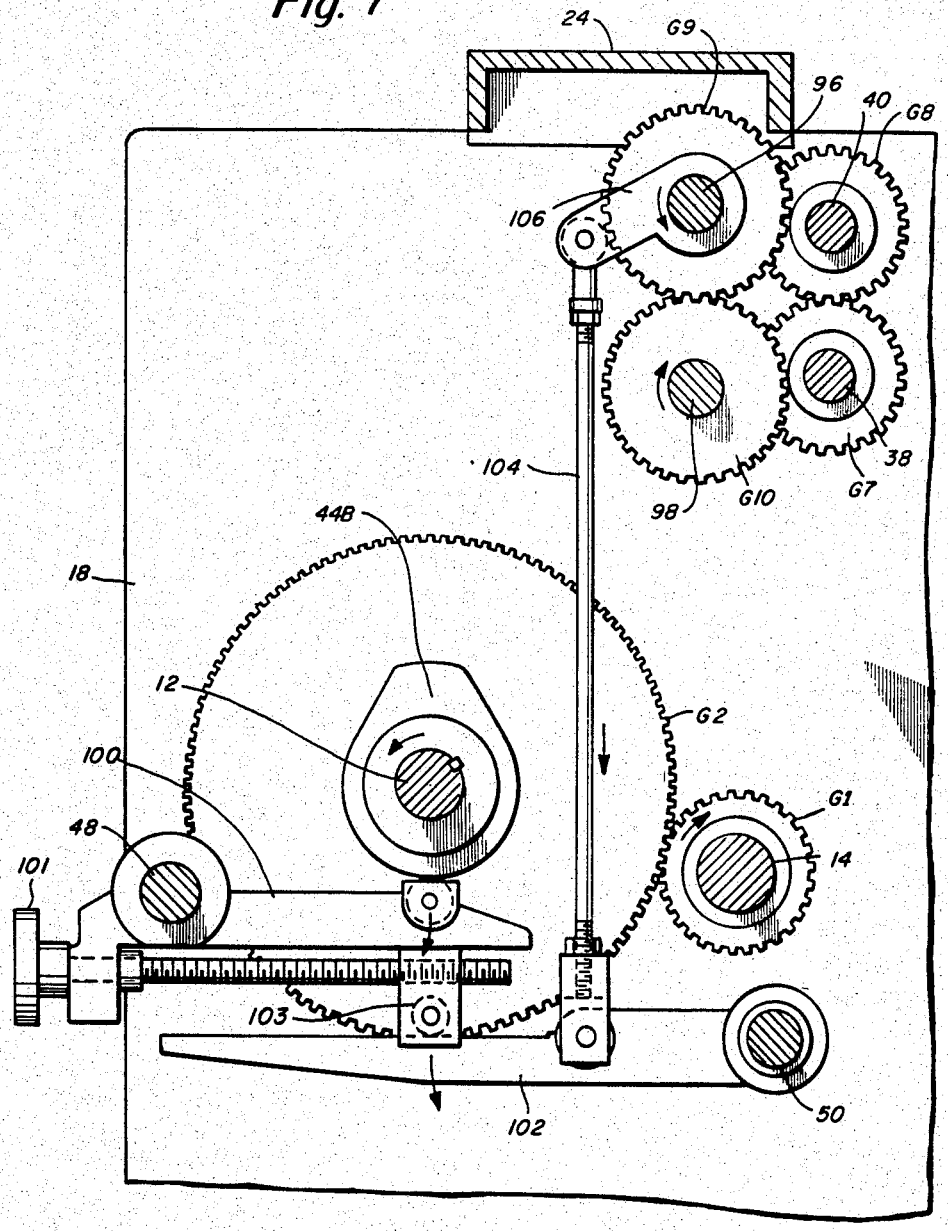
FIG. 7 is a cross-sectional view showing further cam operation and as taken along line 7—7 of FIG. 2.

Reference is also now made to FIG. 7 which shows these cut-off or rocker shafts 96 and 98 which have mounted thereto gears G9 and G10. Also note FIG. 2 which shows the placement of these gears G9 and G10 as far as their position along each of these rocker shafts. The inter-engagement between the gears G9 and G10 provides for in tandem operation of the two cutter shafts. Of course, with only one cutter mounted in the disclosed embodiment then only one of the cutters is operable even though both shafts rotate. FIG. 7 also shows the cam shaft 12 and the cam arm pivots 48 and 50. The cam shaft 12 in the illustration of FIG. 7 carries a cam 44B, also illustrated in FIG. 2. Mounted to the cam arm pivot 48 is an adjustable bias cam follower 100 which may be of standard construction. The cam follower 100 interacts with a second cam follower 102 pivoted from shaft 50. There is in turn provided a connecting rod 104 that couples from cam follower 102 to rocker member 106 secured to the upper rocker shaft 96. When the camshaft 12 rotates to a position where the high point of the cam 44B engages the cam follower 100, the cam follower 100 is rotated in a clockwise direction causing a corresponding counter clockwise rotation of the other cam follower 102. This action causes the connecting rod 104 to move in the direction of the arrow illustrated in FIG. 7 to in turn cause rotation of shafts 96 and 98. This action causes the cutting tool 92 to move to the position shown in FIG. 6 wherein the cutter 92 is brought into engagement with the wire 42 and severs it against the cutting edge of the arbor. The cam follower 100 has associated therewith an adjusting knob 101 for adjusting the position of block 103 relative to cam follower 102. The cutting action is synchronized with the intermittent interruption in feed which in this embodiment is accomplished as discussed previously by a lifting of the top feed roller. Thus, the high points on the cams 44A and 44B should substantially correspond as to their position with perhaps the width of the high point of the cam 44A being somewhat wider than the width of the high point of the cam 44B. This is to assure that the interruption occurs at least to a small extent prior to cutting and furthermore that the resumption of feed does not occur until the cutting has been accomplished.

As indicated previously the wire 42 is fed forward from a suitable supply to the work station at which is located the coiling point and arbor. This is accomplished by frictional engagement between the two feed rollers 39 and 41. These rollers are preferably grooved rollers being provided with several grooves of different sizes so as to accommodate wires of different gauges. The various types of coiling points and associated mechanisms are preferably mounted for adjustment in accordance with standard practice regarding these machines. Also, these mechanisms including the coiling point are aligned so that they are in the proper position with regard to the wire feeding groove that is selected on the feed rollers.

In FIGS. 1–9 there has been described a preferred embodiment of the present invention wherein a variable speed of the feed rollers is employed in combination with the synchronizing of feed interruption in the preferred embodiment by means of a disengagement of the feed rollers with the wire. Now, FIG. 10 illustrates a somewhat alternate embodiment as far as the intermittent interruption is concerned. It is intended that the variation of FIG. 10 be used with the basic machine shown in FIGS. 1–9 but that instead of having cam operation for lifting one of the feed rollers, there is provided a special clutching arrangement. In FIG. 10 some like reference characters will be used to identify similar parts previously described in connection with the preferred embodiment. Thus, in FIG. 10 there are provided the upright support members 16 and 18, along with the pair of gears G7 and G8. FIG. 10 also illustrates the feed roller shafts 38 and 40 along with the respective feed rollers 39 and 41. We also illustrate the wire 42 disposed between these feed rollers. FIG. 10 also illustrates the gear G6 which was the gear driven from the intermediate shaft 26 which is not shown in FIG. 10. Thus, the main feed roller shaft 38 in accordance with this variation is essentially interrupted as far as its drive is concerned from the gear G6 by means of an electric declutch mechanism 110 which may be a conventional standard mechanism. This mechanism is illustrated as connecting to an AC power source and also having a pair of lines coupling to switch 112. This switch 112 is operated from a cam 114 associated with the cam shaft 12. The cam 114 operates similarly to the cam 44A described previously in connection with FIG. 4. With the embodiment of FIG. 10 the switch 112 is intermittently operated from the high point of the cam to deactivate the clutch mechanism and essentially intermittently interrupt the drive to the feed roll shaft 38. This intermittent interruption of course also interrupts the drive to the shaft 40 and for a brief period of time the wire feed ceases. This camming action to cease feed is synchronized by proper placement of the cam and associated switch so that this intermittent interruption occurs at the minimum, or about the minimum speed of the feed rollers. Again, reference is made to FIG. 9 and the point or area X wherein the camming would occur to operate the declutch mechanism 110.

Figure 11:
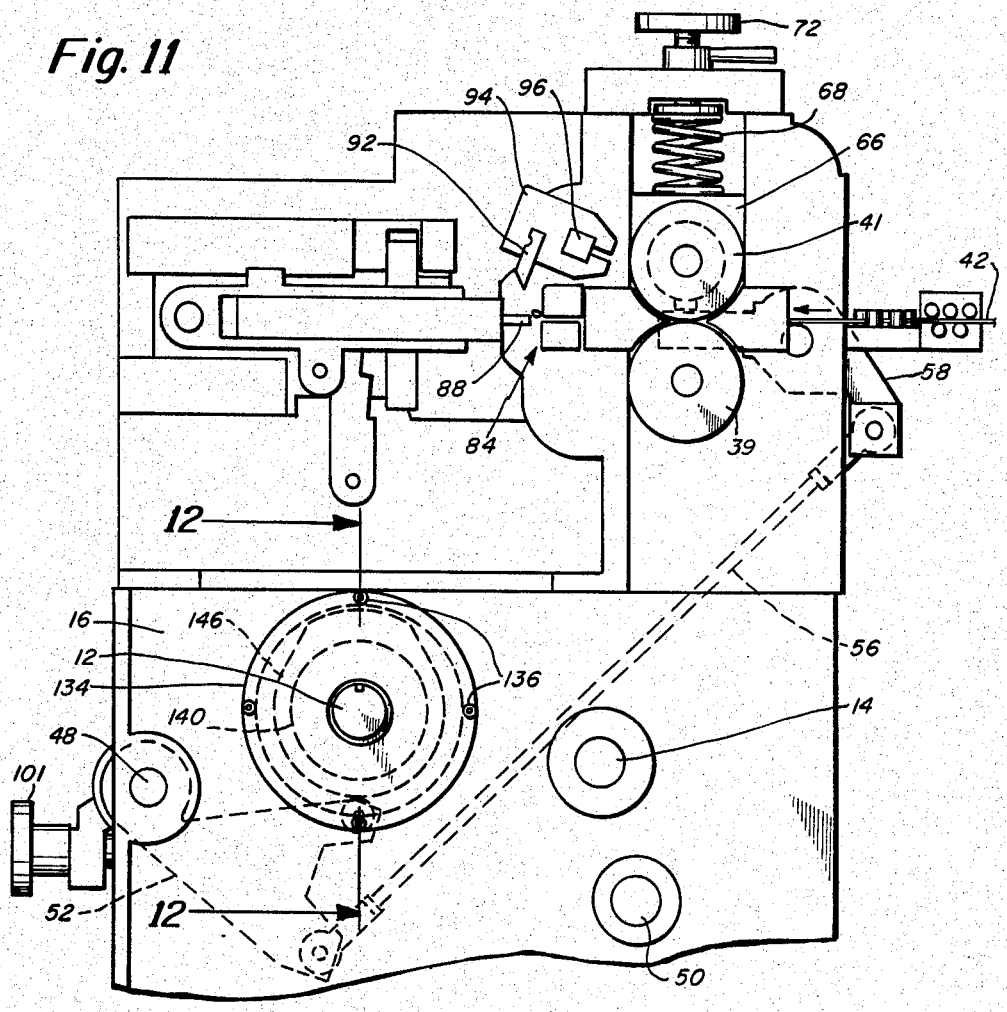
FIG. 11 is a side elevation view of an alternate embodiment of the present invention showing a preferred form of camshaft support.

FIG. 11 is a side elevation view of an alternate embodiment of the machine wherein the cam shaft is supported in a manner where it can be easily removed from the machine or where at least the cam hubs themselves can be easily withdrawn off of the cam shaft. In FIGS. 11–14, like reference characters identify like components previously described in connection with FIGS. 1–10. Thus, there is shown in FIG. 11 a cam shaft 12 and a drive shaft 14. FIG. 11 also shows a cam follower arrangement. However, it is understood that other forms of cam followers may also be employed in accordance with the invention. Also, different forms of the cam itself may be employed in accordance with the machine of this invention.

Figure 12:
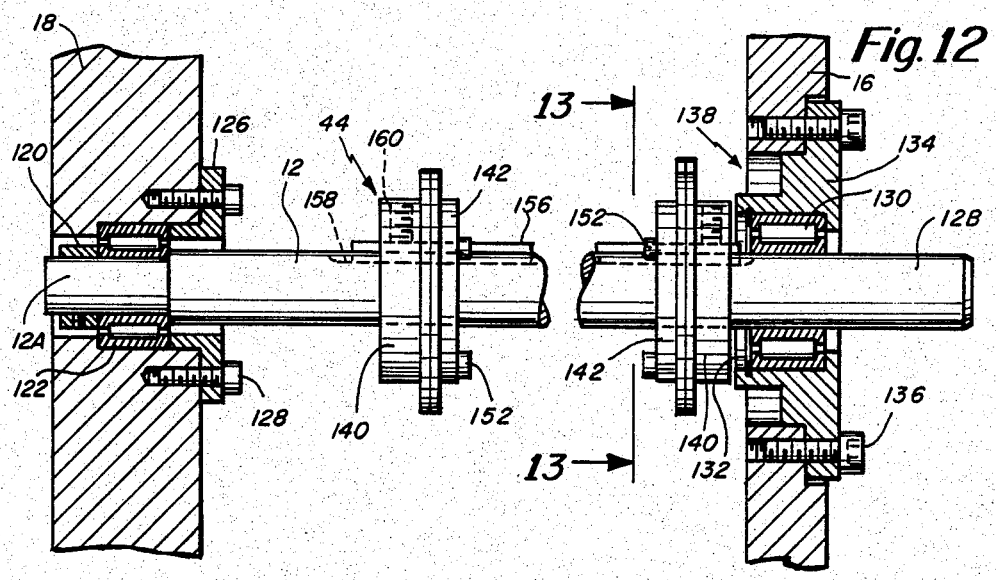
FIG. 12 is a cross-sectional view through the housing and camshaft as taken along line 12—12 of FIG. 11.
Figure 13:
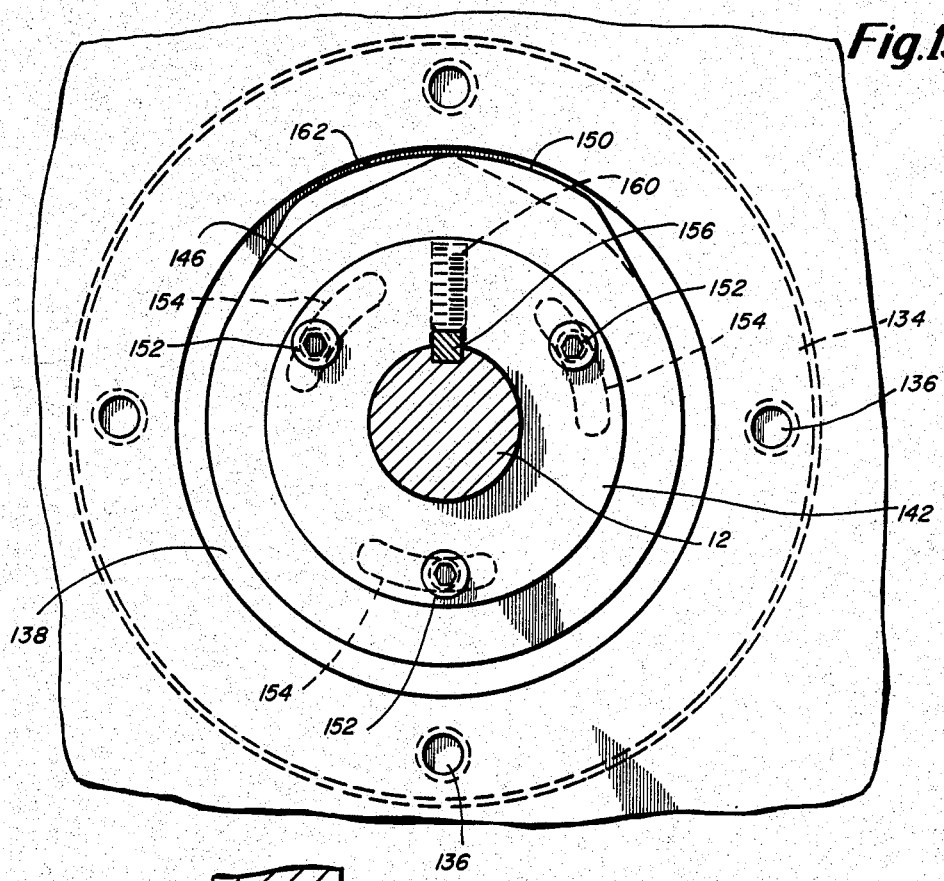
FIG. 13 is a further cross-sectional view of the arrangement shown in FIG. 12 taken along line 13—13.
Figure 14:
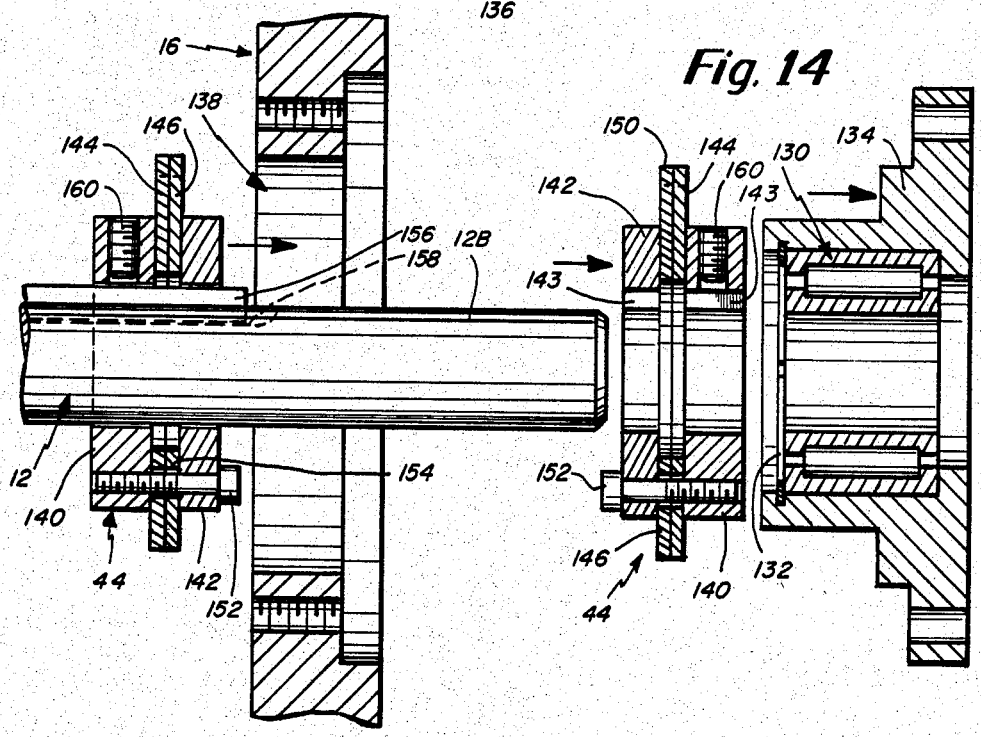
FIG. 14 is a cross-sectional view showing separate components associated with the camshaft and support thereof.

FIGS. 12–14 show the cam shaft 12 having opposite ends supported in upright support members 16 and 18. The cam shaft 12 has a reduced diameter end 12A with a locking sleeve 120 adapted to fix the support bearing 122. The bearing 122 is supported between the end 12A and the support member 18. The bearing 122 may be a needle bearing or roller bearing. The other side of the bearing is supported and held in position by means of the support member 126 which is secured by bolts 128 to the support member 18. The sleeve 120 is suitably secured such as by a set screw to the reduced diameter end 12A of the cam shaft 12.

At the end 12B of the cam shaft there is also provided suitable support including a roller bearing 130 and associated snap ring 132. The bearing 130 is situated between the end 12B and the removable support disk 134. The disk 134 is secured to the support member 16 by means of bolts 136. The disk 134 covers a circular opening 138 in the support member 16. The diameter of the opening or aperture 138 is slightly larger than the maximum diameter of any of the cams fixedly supported on the cam shaft 12.

Mounted on the cam shaft 12 are a plurality of cams 44 each of which comprise a pair of hubs 140 and 142 having sandwiched therebetween cam members 144 and 146. FIG. 13 shows the configuration of the cam members. These cam members may be rotated relative to each other to provide different predetermined cam surfaces such as the cam lobe 150 shown in FIG. 13. The cam members are secured within the hubs by a series of three bolts 152. Each of the cam members is provided with an elongated slot 154 which enables the cam members to be relatively rotatable to vary the width of the cam lobe depending upon the particular application. The cam hubs are both provided with slots 143 engaged by the key 156. This key also fits within a slot 158 in the cam shaft 12. This slot is an elongated slot that may run a substantial length of the cam shaft between the upright support walls 16 and 18. The cam is situated at the proper position along the cam shaft by means of a set screw 160. A common key 156 is preferably used in association with each of the cams.

The cam members 144 and 146 may be moved to various positions to provide different lobe configurations. Also, these members may be moved so that the lobe occurs at any position about the cam with relationship to the cam shaft. In accordance with the present invention the opening 138 covered by the support disk 134 is of a diameter sufficiently large to accommodate the cams 144. In this connection it is noted in FIG. 13 that there is provided at least a small gap 162 between the opening 138 and the maximum diameter of the cam which normally occurs at the lobe 150. In this way, when the disk 134 is removed to essentially remove support at the end 12B of the cam shaft, then the cams can be loosened by loosening the set screw 160 to permit the cams to be removed from the cam shaft and passed through the opening 138 and off of the cam shaft. FIG. 14 shows a left hand cam still remaining on the cam shaft and a right hand cam that has been removed off of the cam shaft. FIG. 14 also shows the support disk 134 removed from the cam shaft to permit removal of the cams.

This feature permits the operator of the machine to categorize cams and permits the operator to maintain the cams in their preset state. Thus, for a particular operation such parameters as pitch, diameter and feed can be controlled and the particular setting can be maintained. A series of these cams can be stored in a set with all of the cams maintained in their predetermined state so that they can be used again in the set to produce a particular spring configuration. In this way the operator does not have to precisely reset each of the cams each time that a new spring configuration is to be made. This is a time consuming operation that can be eliminated by means of permitting the removal of the cams from the cam shaft for storage and subsequent use. This is accomplished in accordance with the present design by providing a support member that permits easy withdrawal of the cams from the cam shaft without removal of the cam shaft.

In an alternate embodiment of the invention one could also remove the entire cam shaft maintaining all cams in tact on the shaft. This may be accomplished with the configuration shown in FIGS. 11–14 simply by removing, not only the support disk 134 but also the support member 126, thus permitting removal of the entire cam shaft. This makes replacement at a later date quite easy in that all of the cams are held in position on the cam shaft. However, from the standpoint of economy it is preferred to use the cam shaft for all configurations with the cams being removed therefrom and with each categorized for subsequent use. For some applications there may be five or more cams associated with a particular form of operation and thus this saves considerable time in requiring resetting of the cams for applications requiring concise cam control.

Having now described a preferred embodiment of the present invention, it should now be understood by those skilled in the art that numerous modifications may be made in the construction within the principles of this invention. It is also understood that other types of cam operations are normally employed in connection with a wire coiling machine of this type. However, in order to describe the principles of the present invention only the primary camming has been described believed to be necessary in explaining the theory of the invention.

What is claimed is:

1. In a wire coiling machine having a work station at which a coil spring or the like is formed including spring pitch and diameter tool controls and a pair of feed rollers between which the wire is fed, the improvement comprising;

means connected to said feed rollers for driving including means for rotating at least one of the feed rollers at a variable drive speed to, in turn, feed the wire at a variable speed to the work station, means for controlling wire feed to intermittently interrupt wire feed in synchronism with the cutting of the wire subsequent to the coiling thereof, said means for driving comprising means for controlling the speed of wire feed to have a maximum speed feed while coiling and decreasing to a minimum speed feed in synchronism with the intermittent interruption of wire feed, said means for driving further comprising a drive shaft and means for powering the drive shaft, a cam shaft, gear means driving the cam shaft from the drive shaft to provide said variable drive speed, a plurality of cams separately and spacedly disposed along the cam shaft and including cams for controlling at least spring pitch and spring diameter, and means for supporting the cam shaft including housing means enclosing the cams and having an opening for receiving the cam shaft and a support member having means defining a bearing surface for the cam shaft and secured to the housing means about the housing means opening to cover said opening, said opening being of greater diameter than the cam maximum diameter, whereby the cams may be withdrawn through the housing means opening when the support member is removed.

2. In a wire coiling machine as set forth in claim 1 wherein said means for driving includes non-circular gear means to provide the variable speed drive.

3. In a wire coiling machine as set forth in claim 2 including an intermediate shaft, said non-circular gear means including engaging non-circular gears associated, respectively, with the camshaft and intermediate shaft for driving the intermediate shaft at a variable speed when the camshaft is driven at a constant speed.

4. In a wire coiling machine as set forth in claim 3 wherein the non-circular gears are elliptical gears.

5. In a wire coiling machine as set forth in claim 4 wherein both feed rollers are driven from said intermediate shaft.

6. In a wire coiling machine as set forth in claim 5 wherein the speed ratio from maximum to minimum is on the order of 4 to 1.

7. In a wire coiling machine as set forth in claim 1 wherein said means for controlling wire feed comprises means for intermittently separating the feed rollers to stop wire feed.

8. In a wire coiling machine as set forth in claim 7 wherein said means for separating includes means for lifting one of the feed rollers relative to the other feed roller which is stationary.

9. In a wire coiling machine as set forth in claim 8 including cam means responsive to said cam shaft for operating said means for lifting.

10. In a wire coiling machine as set forth in claim 9 including means for biasing the one roller toward the other feed roller.

11. In a wire coiling machine as set forth in claim 1 wherein said means for controlling wire feed comprises clutch means for intermittently interrupting feed roller rotation.

12. In a wire coiling machine as set forth in claim 11 wherein said clutch means is operated to cease wire feed in synchronism with minimum feed roller speed.

13. In a wire coiling machine as set forth in claim 1 wherein said removable support member comprises a removable disk secured to the housing means of the wire coiling machine.

14. In a wire coiling machine as set forth in claim 13 wherein said means defining a bearing surface includes bearing means for supporting one end of the camshaft.

15. In a wire coiling machine as set forth in claim 1 wherein each cam comprises a pair of cam members adjustable relatively to provide a range of cam lobe configurations.

16. In a wire coiling machine having a work station at which a coil spring or the like is formed, including spring pitch and diameter tool controls, means for feeding the wire to the work station and housing means having supported therein and enclosing a camshaft having a plurality of cams secured thereto including at least one cam for controlling respective pitch and diameter tools, said camshaft being coupled to a drive source by gear means, said camshaft being rotatably supported at opposite ends, means for supporting the camshaft including said housing means having an opening for receiving the camshaft and a support member having means defining a bearing surface for the cam shaft and secured to the housing means about the housing means opening to cover said opening, said opening being of greater diameter than the cam maximum diameter, whereby the cams may be withdrawn through the housing when the support member is removed.

17. In a wire coiling machine as set forth in claim 16 wherein said support member includes a bearing supported therein, and a second support member and associated bearing at the other end of the camshaft.

18. In a wire coiling machine as set forth in claim 16 wherein said camshaft support limits the camshaft to rotation with absence of any substantial axial displacement.

19. In a wire coiling machine as set forth in claim 16 including means securing the cams in a spaced fashion along the camshaft.

20. In a wire coiling machine as set forth in claim 19 wherein said cam securing means includes means for keying each cam to the camshaft whereby upon removal therefrom the cam can be subsequently resecured to the camshaft at the same position and with the same cam configuration.

21. In a wire coiling machine as set forth in claim 20 wherein said means for keying includes a set screw means for disposing the cams at predetermined positions along the camshaft and also in predetermined radial position.

22. In a wire coiling machine as set forth in claim 20 wherein each of the cams is separately settable to provide different cam configurations for controlling pitch and diameter tools.

* * * * *